US005370304A

United States Patent [19]

Sauerwine et al.

[11] Patent Number: 5,370,304

[45] Date of Patent: Dec. 6, 1994

[54] SINGLE-PLY UNEVEN DOUBLE PARALLEL FOLD BUSINESS FORM ASSEMBLY WITH OR WITHOUT RETURN ENVELOPE

[75] Inventors: Dean N. Sauerwine, Zionsville; William K. Wetherhold, Jr., Quakertown, both of Pa.

[73] Assignee: Moore Business Forms, Inc., Grand Island, N.Y.

[21] Appl. No.: 67,968

[22] Filed: May 27, 1993

[51] Int. Cl.[5] ..... B65D 27/04; B65D 27/06

[52] U.S. Cl. ..... 229/304; 229/92.3

[58] Field of Search ..... 229/304, 305, 92.1, 229/92.3, 69

[56] References Cited

U.S. PATENT DOCUMENTS

| | | | |
|---|---|---|---|
| 3,143,279 | 8/1964 | Black . | |
| 3,255,952 | 6/1966 | Black . | |
| 3,312,385 | 4/1967 | Amort | 229/69 |
| 3,523,638 | 8/1970 | Moonan | 229/92.1 |
| 3,652,007 | 3/1972 | MacDougall . | |
| 3,693,869 | 9/1972 | Eaves | 229/304 |
| 4,044,942 | 8/1977 | Sherwood | 229/309 |
| 4,081,127 | 3/1978 | Steidinger | 229/69 |
| 4,575,121 | 3/1986 | Conti . | |
| 4,754,915 | 7/1988 | Steidinger . | |
| 4,799,618 | 1/1989 | Jenkins . | |
| 4,928,875 | 5/1990 | Hutchinson | 229/92.1 |
| 5,048,748 | 9/1991 | Martin et al. | 229/92.1 |

*Primary Examiner*—Stephen P. Garbe
*Attorney, Agent, or Firm*—Nixon & Vanderhye

[57] ABSTRACT

A single-ply is folded about a transverse fold line longitudinally offset from a median through the ply and folded about parallel substantially coincident axes to form first, second, third and fourth panels of a mailer assembly. Longitudinally extending lines of perforations define marginal tear strips and transversely extending lines of perforations on the second and third panels adjacent the middle fold line and adjacent a free end of the first panel register with one another to form an end tear strip adjacent the top or bottom of the mailer. Where a return envelope is required, one of the panels has a U-shaped pattern of heat-sealable adhesive to join a pair of registering panels one to the other, with another panel forming a closure flap bearing rewettable adhesive.

16 Claims, 7 Drawing Sheets

Fig. 1
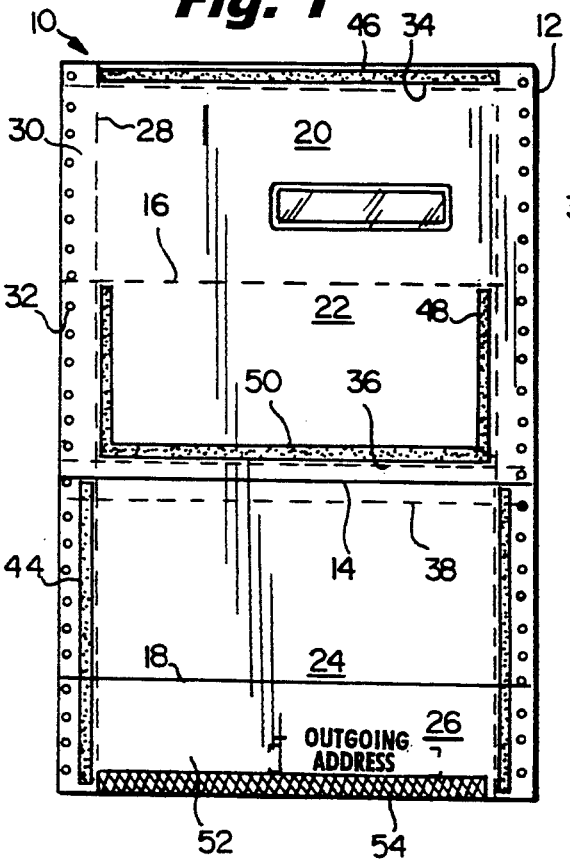
Fig. 2
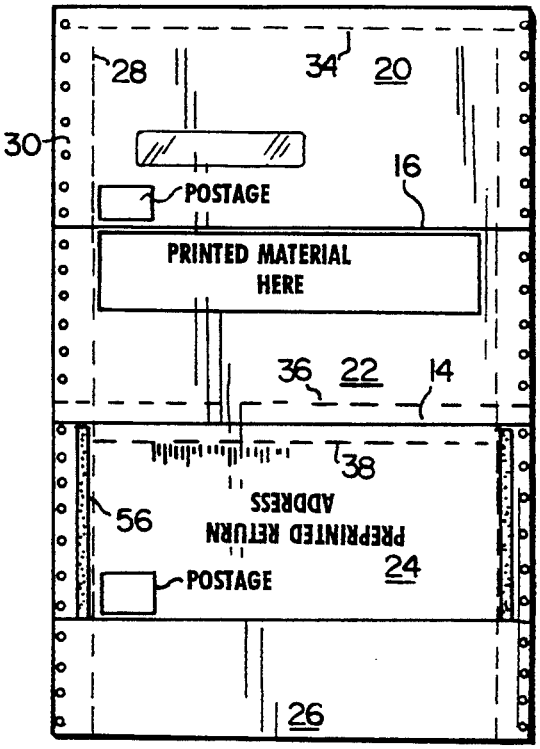
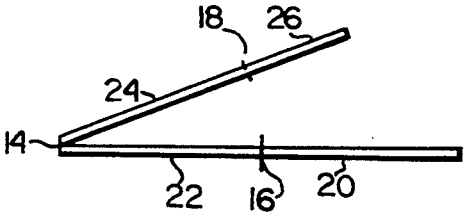
Fig. 3a
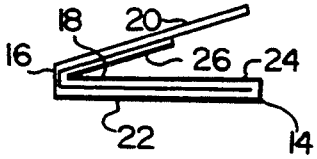
Fig. 3b
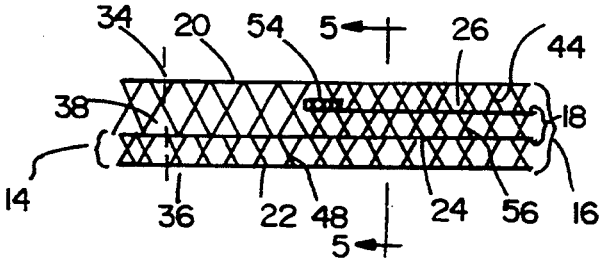
Fig. 4

Fig. 7
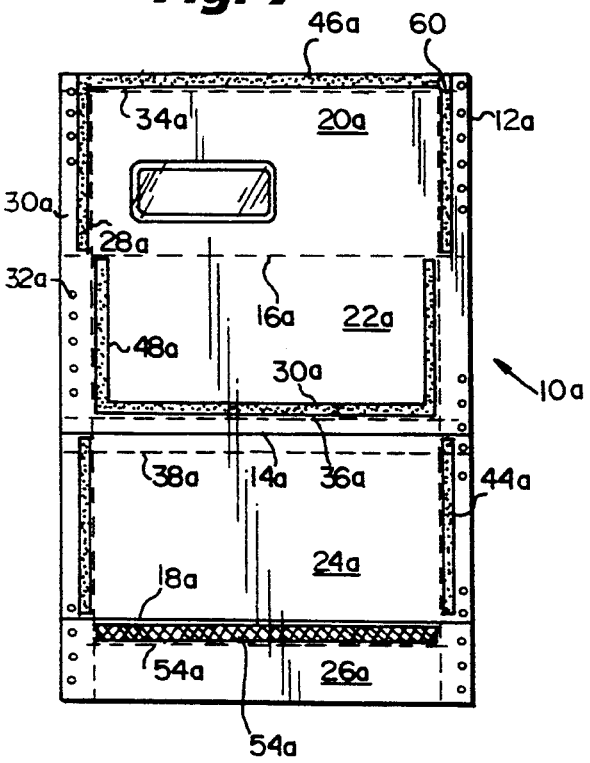
Fig. 8
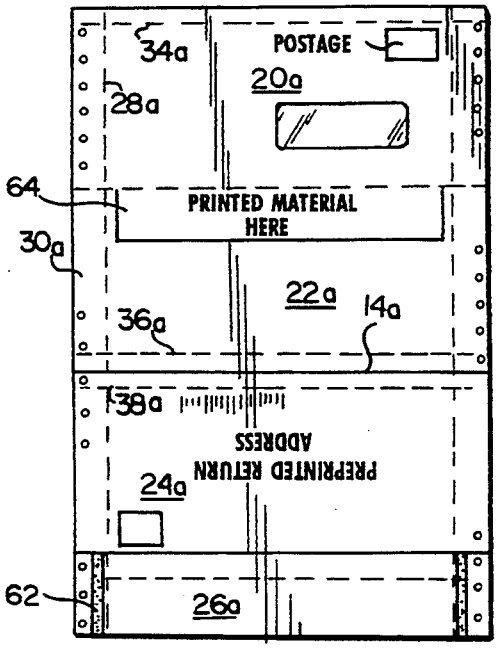
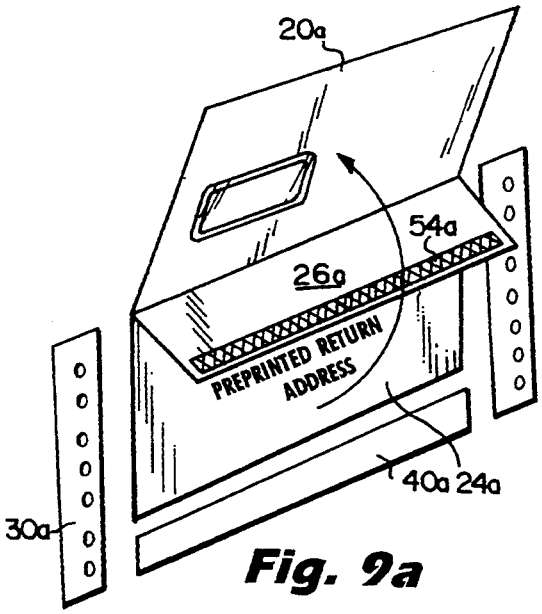
Fig. 9a
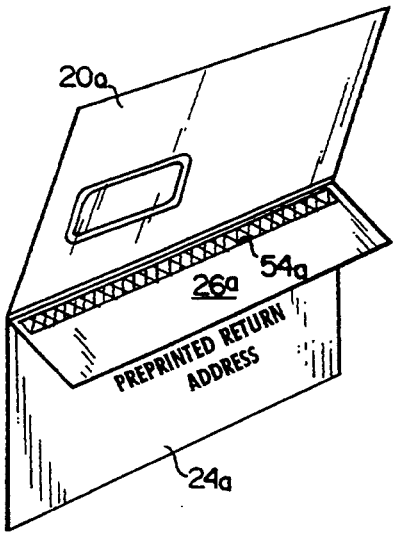
Fig. 9b

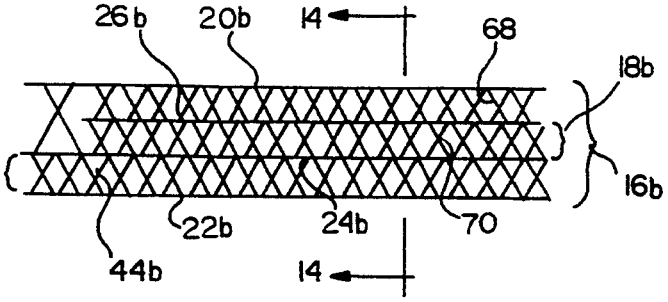
Fig. 13
Fig. 14
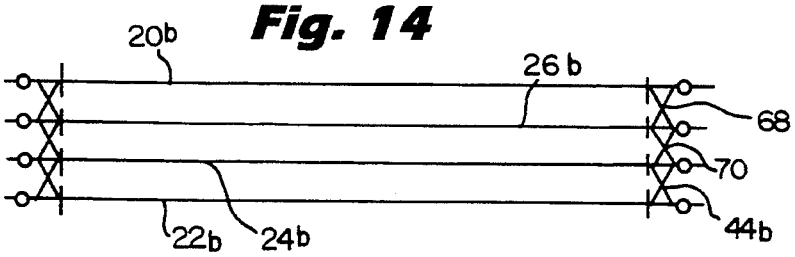
Fig. 15
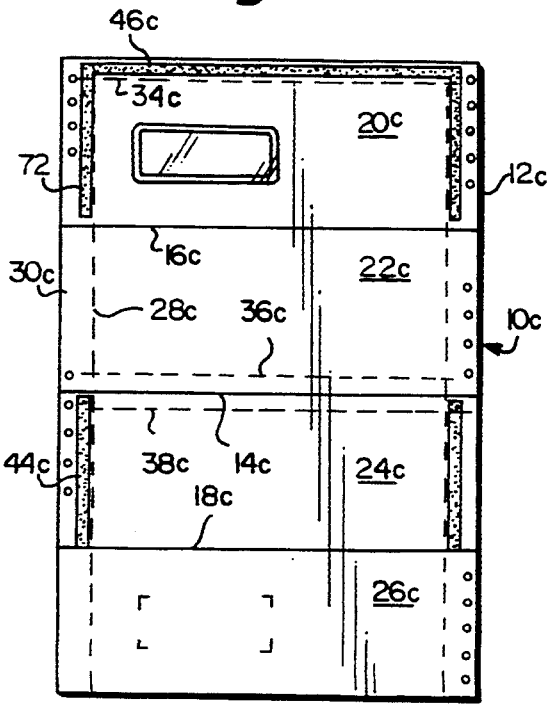
Fig. 16
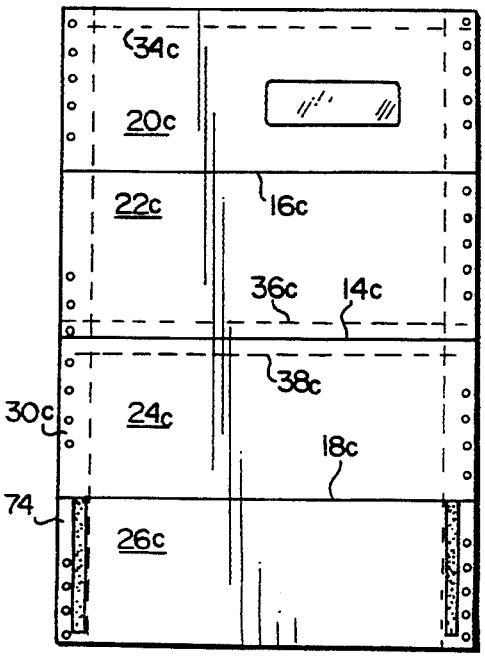

SINGLE-PLY UNEVEN DOUBLE PARALLEL FOLD BUSINESS FORM ASSEMBLY WITH OR WITHOUT RETURN ENVELOPE

TECHNICAL FIELD

The present invention relates to a business form assembly and particularly relates to a mailer formed of a single ply and unevenly double parallel folded to create a multi-panel form. Additionally, the single-ply multi-panel form may include an address panel, panels forming a return envelope, an area for printing, for example, a statement and various stubs for return with the envelope.

DISCLOSURE OF THE INVENTION

According to the present invention, a single ply or sheet of paper is preprinted with appropriate information, either variable or non-variable, for example, discrete addresses of customers and standard instructions, respectively. The ply may be provided with an appropriate mailing window, heat-sealable adhesives, as well as rewettable adhesives for those form assemblies including a return envelope, and die cut lines of perforations applied at appropriate locations along the ply. To form the business form assembly according to the present invention, the single ply or sheet is unevenly folded about a first fold line such that one of the transversely extending edges lies short of the transversely extending edge at the opposite end of the single sheet. The ply is then folded about second and third transversely extending fold lines substantially coincident one with the other to define and locate first, second, third and fourth panels in registration with one another. By folding the ply in this manner, the four registering panels form a mailer with the free edge of the fourth panel terminating short of the first fold line and lying adjacent a lateral edge of the mailer.

More particularly, tractor feed strips are provided along opposite lateral margins of the form and are defined by marginal lines of perforations extending longitudinally along the form. Heat seal adhesive is provided along the feed strips laterally outwardly of the lines of perforations and along only portions of the feed strips such that, in assembly, the panels are sealed along opposite lateral sides. A first transverse line of perforations is spaced inwardly of the free end edge of the first panel and a pair of lines of perforations extend transversely on opposite sides of the first fold line in the second and third panels. When the assembly is folded, as indicated above, the first, second and third lines of perforations register one with the other to form a transversely extending tear strip along an edge of the mailer.

In those embodiments hereof wherein a return envelope is formed in the mailer, heat-sealable adhesive is applied longitudinally along one panel inwardly of the marginal lines of perforations and a transversely extending heat-sealable adhesive is applied to that same panel adjacent a fold line to form a generally U-shaped heat-sealable adhesive pattern for sealing against a registering panel in the folded mailer assembly. Another panel is provided with a transversely extending rewettable adhesive adjacent an edge whereby such other panel forms a closure flap which can be adhesively sealed to the return envelope. In the first two embodiments of the present invention, the return envelope is formed by registering second and third panels and the closure flap is formed in the fourth shortened panel. In a fifth embodiment of the present invention, the return envelope is formed by registering first and fourth panels, with the closure flap forming part of the first panel.

By the foregoing construction and in all five embodiments, essentially a four-panel form assembly is provided which can be opened by removing the tear strips along marginal sides of the mailer and along either the top or bottom of the mailer. The mailer is, of course, completely sealed along all edges by a fold line and the heat-sealable adhesive along the remaining three margins. By folding the ply in this manner, fewer lines of perforations are needed to complete the form assembly as compared with previous multi-sheet mailers, while still enabling the assembly to be used as a mailer.

In a preferred embodiment according to the present invention, there is provided a business form assembly comprising an elongated single ply of paper folded about first, second and third transversely extending parallel fold lines to form first, second, third and fourth transversely extending panels with the first and second panels forming outside panels and the third and fourth panels within the first and second panels, the first fold line being offset from a median across the ply such that the fourth panel is shorter in longitudinal extent than the longitudinal extent of each of the first, second and third panels and terminates along an edge of the ply spaced from the first fold line. Marginal lines of perforations extend longitudinally, parallel to one another, adjacent opposite edges of the ply and normal to the fold lines defining tractor feed strips along longitudinally extending opposite margins of the ply. A first line of perforations is spaced inwardly of an edge of the first panel and the ply and extends transversely substantially between opposite edges of the ply, second and third lines of perforations extending transversely between the marginal lines of perforations in the second and third panels generally parallel to and spaced equidistantly on opposite sides of the first fold line, respectively. A first line of adhesive extends transversely generally parallel to the edge of the first panel and between the feed strips for sealing the first panel and the third panel adjacent the first fold line, the first line of adhesive lying between the edge and the first line of perforations in the first panel, with marginal lines of adhesive along at least portions of the feed strips and laterally outwardly of the marginal lines of perforations to maintain the form in assembly whereby, upon folding the ply to form the assembly, the first, second and third transversely extending lines of perforations lie in registry one with the other forming a transversely extending tear strip adjacent one laterally extending edge of the form assembly, while the marginal lines of perforation adjacent opposite edges of the ply register one with the other, forming a pair of tear strips along opposite margins of the form assembly.

In a further preferred embodiment according to the present invention, there is provided a business form assembly comprising an elongated single ply of paper folded about first, second and third transversely extending parallel fold lines to form first, second, third and fourth transversely extending panels with the panels in registration with one another, a pair of the panels forming outside panels and another pair of the panels forming inside panels, the first fold line being offset from a median across the ply such that one of the panels is shorter in longitudinal extent than the longitudinal extent of each other of the panels. Marginal lines of perforations extend longitudinally, parallel to one another, adjacent opposite edges of the ply and normal to the fold lines defining tractor feed strips along longitudinally extending opposite margins of the ply. A first line of perforations is spaced inwardly of an edge of one of the outside panels and the ply and extends transversely substantially between opposite edges of the ply, second and third lines of perforations extending transversely between the marginal lines of perforations in the inside panels generally parallel to and spaced equidistantly on opposite sides of the first fold line, respectively. A first line of adhesive extends transversely generally parallel to the edge of the one outside panel and between the feed strips for sealing the one outside panel and the one of the inside panels adjacent the first fold line, the first line of adhesive lying between the edge of the one outside panel and the first line of perforations in the one outside panel. Marginal lines of adhesive extend along at least portions of the feed strips and laterally outwardly of the marginal lines of perforations to maintain the form in assembly whereby, upon folding the ply to form the assembly, the first, second and third transversely extending lines of perforations lie in registry one with the other forming a transversely extending tear strip adjacent one laterally extending edge of the form assembly, while the marginal lines of perforation adjacent opposite edges of the ply register one with the other, forming a pair of tear strips along opposite margins of the form assembly.

Accordingly, it is a primary object of the present invention to provide a novel and improved single-ply uneven double-fold multi-panel business form assembly.

BRIEF DESCRIPTION OF THE DRAWINGS

FIG. 1 is a plan view of a single-ply business form assembly constructed in accordance with the present invention for use as a mailer and illustrating an inside face of the ply from which the mailer is formed;

FIG. 2 is a view similar to FIG. 1 illustrating the reverse or back face of the ply;

FIGS. 3*a* and 3*b* schematically illustrate the manner in which the ply of FIGS. 1 and 2 is folded to form the business form assembly;

FIG. 4 is a schematic cross-sectional representation of the folded business form assembly illustrating the lines of adhesive of the form illustrated in FIG. 1 when in assembly;

FIGS. 7 and 8 are views similar to FIGS. 1 and 2 illustrating a second embodiment of the present invention;

FIGS. 9*a* and 9*b* are perspective views of the business form assembly of FIGS. 7 and 8 with the tear strips removed by the customer and with the drawing figures illustrating two locations of the rewettable adhesive;

FIG. 13 is a schematic representation of the third embodiment of business form assembly hereof illustrating the adhesive lines of the form in assembly;

FIG. 14 is a cross-sectional view thereof generally taken about on line 14—14 in FIG. 13;

FIGS. 15 and 16 are views similar to FIGS. 1 and 2, respectively, illustrating a fourth embodiment of a business form assembly according to the present invention.

BEST MODE FOR CARRYING OUT THE INVENTION

Figure 5:
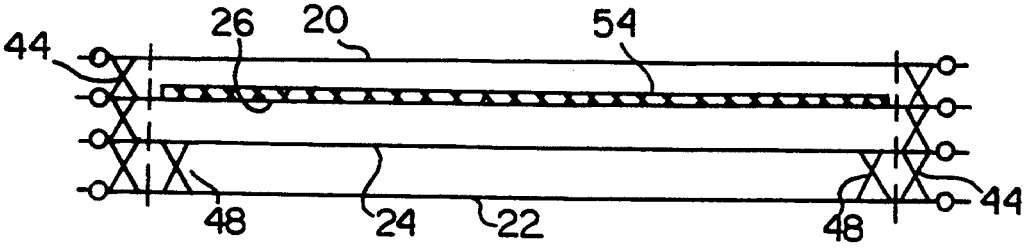
FIG. 5 is a cross-sectional view of the assembly taken generally about on line 5—5 in FIG. 4.

Reference will now be made in detail to a present preferred embodiment of the invention, an example of which is illustrated in the accompanying drawings.

Referring now to the drawing figures, particularly to FIG. 1, there is illustrated a business form assembly, generally designated 10, and constructed in accordance with a first embodiment of the present invention. Business form assembly 10 includes a single ply or sheet of paper 12 which is folded, as described below, to form a mailer having four registering panels. Particularly, ply 12 is folded about a first fold line 14 which is longitudinally offset from a median between the free end edges of the ply and extending transversely across ply 12. Second and third fold lines 16 and 18, likewise extending transversely across ply 12, lie parallel to first fold line 14. The first, second and third fold lines 14, 16 and 18, respectively, define first, second, third and fourth panels 20, 22, 24 and 26, respectively.

When ply 12 is initially folded about first fold line 14 as illustrated in FIG. 3*a*, it will be appreciated that the panels 20, 22 and 24 have substantially the same longitudinal extent whereas panel 26 is longitudinally shorter than any one of the other panels. After folding ply 12 initially about fold line 14, the ply is folded about the second and third fold lines 16 and 18 which lie substantially coincident one with the other when the panels 24 and 26 lie in registration with panels 22 and 20. Adhesives and lines of perforations are variously applied to ply 12, as will now be described, such that a completed mailer can be formed.

Figure 6:
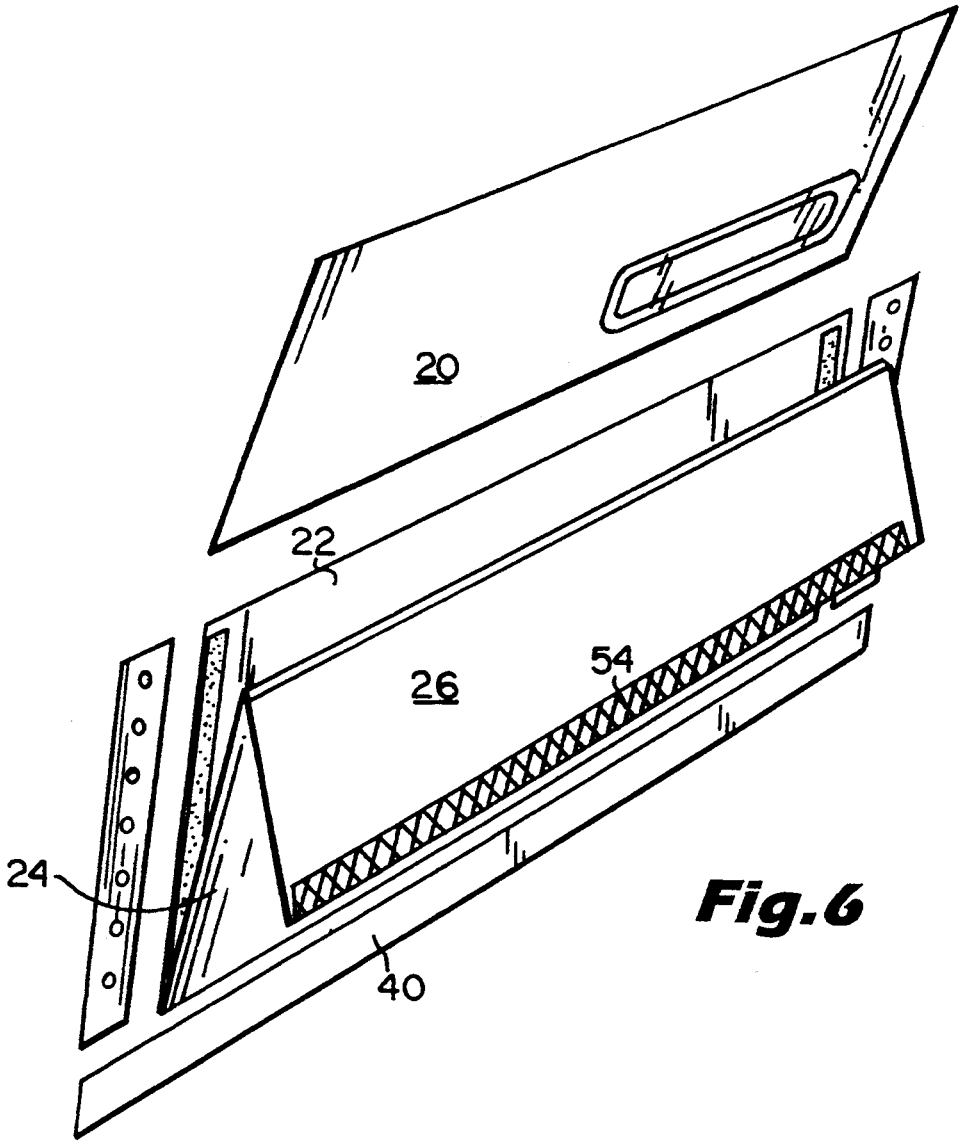
FIG. 6 is a perspective view of the various panels of the form assembly illustrating the manner in which a recipient of the mailer would open the mailer and use the return envelope.
Figure 10:
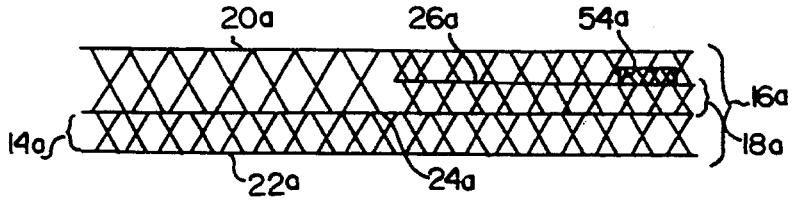
FIG. 10 is a schematic representation of the folded business form assembly of the second embodiment hereof illustrated in FIGS. 7 and 8 and illustrating the lines of adhesive of the form when in assembly.
Figure 11:
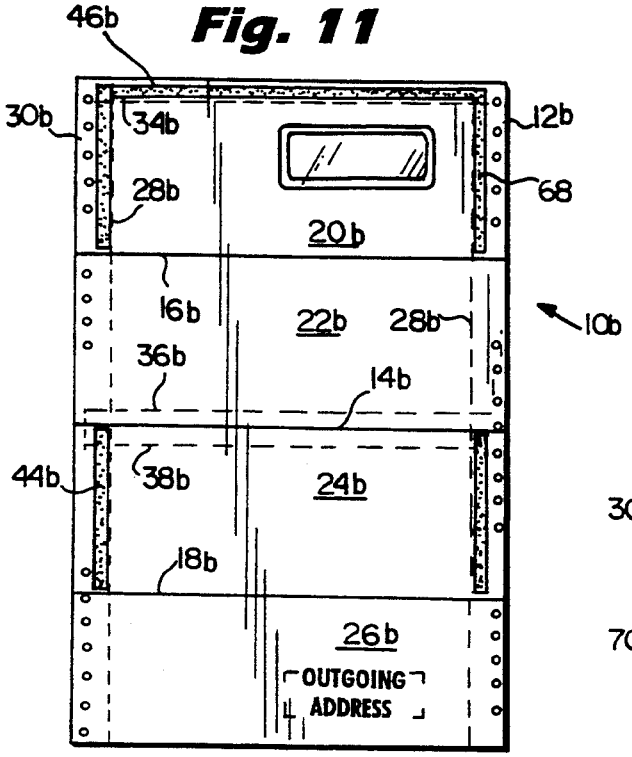
FIGS. 11 and 12 are views similar to FIG. 1 illustrating a third embodiment of the present invention.

Ply 12 initially forms part of a continuous web of paper 12 which is cut or burst to form discrete plies 12 which may then be folded, as indicated above. Particularly, in each ply 12, marginal lines of perforations 28 extend longitudinally along opposite lateral edges to define longitudinally extending tractor feed tear strips 30. As conventional, feed strips 30 have pinholes 32 for receiving the pins of sprocket wheels for conveying the web. Additionally, a first line of perforations 34 extends transversely along a marginal portion of first panel 20 adjacent its free edge. Second and third lines of perforations 36 and 38, respectively, extend transversely between marginal edges of the ply in the second and third panels 22 and 24, respectively, on opposite sides of and equidistant from first fold line 14. With this arrangement, it will be appreciated that when ply 12 is folded about fold lines 14, 16 and 18, the lines of perforations 34, 36 and 38 will lie in registration with one another, as illustrated in FIG. 4. These registering lines of perforations 34, 36 and 38 form a transversely extending tear strip 40 extending between opposite marginal edges of the form and mailer, as illustrated in FIG. 6. Additionally, the marginal tear strips 30 in each panel overlie one another after the ply is folded and adhesively secured in assembly to form marginal tear strips 42.

To secure the various panels to form a mailer assembly, heat-sealable adhesive 44 is applied to the inside face of panels 24 and 26 along portions of the tear strips thereof and laterally outwardly of the longitudinal extending lines of perforations 28 and inwardly of the pinholes 32. Heat-sealable adhesive 46 is also applied to extend transversely between opposite margins of ply 12 and between the line of perforations 34 and the free edge of first panel 20. On the opposite face of ply 12, there are provided longitudinally extending lines of heat-sealable adhesive 56 along third panel 24 outwardly of the lines of perforation 28 and inwardly of the pinholes 32. Consequently, when the panel is initially folded about first fold line 14, the marginal lines of adhesive 44 in panel 24 register with the marginal tear strips in panel 22 while the marginal adhesive 44 along panel 26 registers with the inside face of the tear strips 30 in panel 20. After folding about the substantially coincident fold lines 16 and 18, the lines of adhesive 56 on the opposite face of panel 24 have portions which will lie in registry with the tear strips 30 along the back face of panel 26 and also portions which lie in registry with the face of first panel 20 illustrated in FIG. 1.

In this embodiment of the present invention, a return envelope forms an integral part of the mailer. To form the return envelope, lines of heat-sealable adhesive 48 extend longitudinally along opposite sides of second panel 22 inwardly of lines of perforations 28. Additionally, a line of heat-sealable adhesive 50 extends transversely between adhesive lines 48 and inwardly of the line of perforations 36 in the second panel 22. Consequently, when the ply 12 is folded about first fold line 14, the lines of heat-sealable adhesive 48 and 50 register with third panel 24 at corresponding locations therealong inwardly of lines of perforations 28 and 38, respectively. Thus, when the adhesive is activated, a return envelope comprising second and third panels 22 and 24 is provided inwardly of lines of perforations 28, 36 and 38. The edges of panels 22 and 24 adjacent fold lines 16 and 18 remain unsecured one to the other.

A return envelope closure flap 52 is provided and comprises the fourth panel 26. A rewettable adhesive 54 extends transversely along the free end edge of panel 26 between the lines of perforations 28.

When ply 12 is folded into assembly as described, it will be appreciated that the lines of adhesive 44 along third panel 24 register with the tear strips 30 along second panel 22 for sealing the second and third panels one to the other along their margins. Additionally, the lines of adhesive 44 along fourth panel 26 will register with the tear strips of first panel 20 for sealing the margins of the fourth panel to a portion of the tear strips along first panel 20 along its inner face. When ply 12 is folded about substantially coincident fold lines 16 and 18, portions of the lines of adhesive 56 on the opposite face of the third panel 24 register with the tear strips along the back face of panel 20 for sealing the third panel to the first and fourth panels. Adhesive line 46 also registers with the back face of the third panel for sealing along the lower edge of the mailer. Lines of adhesive 48 and 50 of the second panel register along corresponding portions of the third panel 24. When folded as described, heat is applied to the assembly activating the heat-sealable adhesive to seal the mailer and simultaneously form the return envelope in the mailer.

When the recipient of the business form assembly receives the mailer, it will be appreciated that the mailer is sealed along its top by the fold line 16, along the sides by the cooperating adhesives 44 and 56 and along its bottom edge by the adhesive line 46 between the first panel 20 and the third panel 24 and between fold line 14 and line of perforations 38. Fold line 14 also forms part of the bottom edge of the mailer. Consequently, side tear strips 30 and a bottom tear strip 40 (FIG. 6) may be removed along the lines of perforations 28 and 34, 36 and 38, respectively, leaving, as illustrated in FIG. 6, the first panel free to unfold about fold line 16 and the fourth panel free to unfold about fold line 18. Because the lines of adhesive 48 and 50 are inward of the lines of perforations 28 and 36, respectively, the securement of the three sides of panels 22 and 24 forming the return envelope is maintained. The user may then remove the first panel 20 along perforations which form the fold line 16. By reverse-folding the fourth panel 26, which forms the closure flap for the return envelope, about fold line 18, over the back face of second panel 22, and wetting the rewettable adhesive 54, the return envelope comprising panels 22, 24 and 26 may be sealed.

Referring now to the second embodiment hereof illustrated in FIGS. 7–10, wherein like reference numerals are applied to like parts, followed by the suffix "a", there is illustrated a business form assembly **10*a* comprised of a single-ply 12*a* folded about offset fold line 14*a* and substantially coincident fold lines 16*a* and 18*a* to form a mailer including registering panels 20*a*, 22*a*, 24*a* and 26*a*. As in the previous embodiment, panel 26*a* has a longitudinal extent shorter than the other panels. Lines of heat-seal adhesive 44*a* are formed along the inner face of panel 24*a* outside of lines of perforation 28*a* but do not, as in the first embodiment, extend into fourth panel 26*a*. Line of adhesive 46*a* extends transversely between the lines of perforations 28*a* in the first panel 20*a* adjacent its free edge. Lines of adhesive 48*a* and 50*a* are formed along the inner face of second panel 22*a* inwardly of lines of perforations 28*a* and 36*a*, respectively, to form with the third panel 24*a* a return envelope similarly as in the first embodiment. In this form, however, lines of adhesive 60 extend longitudinally along the opposite margins of first panel 20*a* outboard of lines of perforation 28*a* and in the tear strips 30*a* thereof. As illustrated in FIGS. 9*a* and 9*b*, the rewettable adhesive 54*a* extends transversely along the fourth panel 26*a* either between line of perforation 55*a* and fold line 18*a* (see FIGS. 7 and 9*b*) or adjacent the free edge of fourth panel 26*a* (see FIG. 9*a***).

To form the mailer of this embodiment, ply **12*a* is folded about offset fold line 14*a* to register the lines of adhesive 44*a* in third panel 24*a* with the marginal tear strips 30*a* in second panel 22*a*, and the lines of adhesive 48*a* and 50*a* inside lines of perforations 28*a* and 36*a*, respectively, with corresponding portions of third panel 24*a*. Upon further folding the ply 12*a* about substantially coincident fold lines 16*a* and 18*a*, fourth panel 26*a* and first panel 20*a* overlie third panel 24*a* to register lines of adhesive 62 along the back face of panel 26*a* with the back face of third panel 24*a* and lines of adhesive 60 with the marginal tear strips 30*a* in the front face of fourth panel 26*a* and the portions of the tear strips 30*a* in the back face of third panel 24*a*. Consequently, when folded and heat is applied, the lines of adhesive 48*a* and 50*a* secure the second and third panels 22*a* and 24*a*, respectively, to one another to form the return envelope. Lines of adhesive 60 on panel 20*a* overlie the fourth and third panels 24a and 26a, sealing therewith along the margins and along a transverse edge of the mailer. In this form, the tear strip 40a forms the upper edge of the mailer as the location of the glassine window indicates, the return envelope being upside-down as the mailer is received by a recipient. The recipient of the mailer may therefore remove the marginal strips 30a and transverse tear strips 40a by tearing along lines of perforations 28a and 34a, 36a and 38a, respectively, leaving only the permanent adhesive forming the return envelope and the rewettable adhesive. In this form, there is also provided an area 64 on the back face of the second panel 22a on which preprinted information can be provided when the rewettable adhesive is provided adjacent the free edge of fourth panel 26a, as illustrated in FIG. 9a**.

Figure 12:
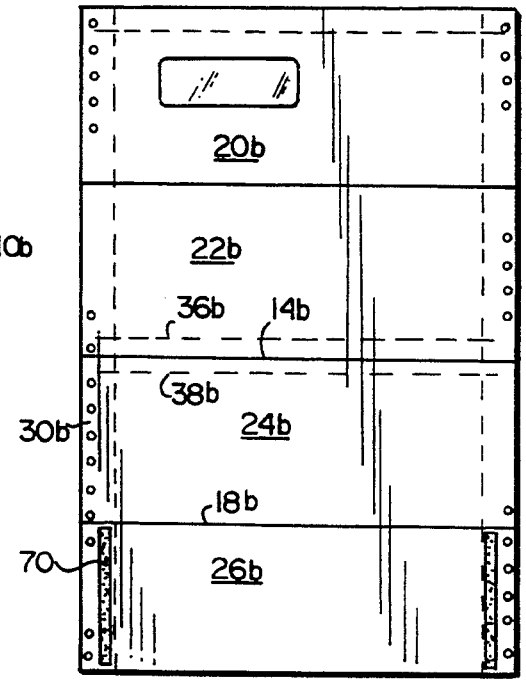

Referring now to the embodiment illustrated in FIGS. 11–14, wherein like reference numerals apply to like parts as in the first embodiment, followed by the suffix "b", there is illustrated a business form assembly 10b comprised of a single-ply 12b having an offset fold line 14b and a pair of fold lines 16b and 18b defining, when folded, first, second, third and fourth panels 20b, 22b, 24b and 26b. As in the first embodiment, longitudinally extending lines of perforations 28b define marginal tear strips 30b and transversely extending perforations 36b and 38b straddle fold line 14b, while line of perforations 34b is inset from the free end edge in panel 20b. Lines of adhesive 68 are provided along the marginal tear strips 30b in first panel 20b outside of lines of perforations 28b. A transversely extending line of adhesive 46b extends along the free edge of panel 20b outwardly of line of perforations 34b. Lines of adhesive 44b extend longitudinally along the tear strips 30b in panel 24b outwardly of lines of perforations 28b. On the back face of the fourth panel 26b as illustrated in FIG. 12, lines of adhesive 70 extend along tear strips 30b outwardly of the lines of perforations 28b.

As in the prior embodiments, the single-ply 12b is first folded about fold line 14b to register first panel 20b with fourth panel 26b and second panel 22b with third panel 24b. Also, the lines of adhesive 68 along tear strips 30b of first panel 20b register with the tear strips 30b in panel 26b, while the lines of adhesive 44b in third panel 26b register with the tear strips 30b of panel 22b. As in the previous embodiment, panel 26b is shorter in length than any of the other panels. When the assembly is folded along the substantially coincident fold lines 16b and 18b, the lines of adhesive 70 along the back face of tear strips 30b of fourth panel 26b register with the back face of tear strips 30b in third panel 24b. Additionally, the transverse line of adhesive 46b outside the free edge of panel 26b registers with the back face of third panel 24b between the line of perforations 38b and fold line 14b. Thus, in assembly, the mailer is sealed about its periphery by adhesive 44b sealing between the second and third panels, adhesive 68 sealing between the first and fourth panels, adhesive 70 sealing between the third and fourth panels, and adhesive 46b sealing the free edge of first panel 20b to the third panel 24b.

To open the mailer, the recipient tears the marginal strips 30b along registering lines of perforations 28b and, at the bottom of the mailer, along the registering lines of perforations 34b, 36b and 38b. It will be noted that the inner faces of panels 22b, 24b and 26b may contain variable or non-variable information and are sealed within the mailer. Additionally, the back faces of third and fourth panels 24b and 26b, respectively, are closed within the mailer and likewise can be provided with variable and non-variable information.

Referring now to the fourth embodiment hereof illustrated in FIGS. 15 and 16, the mailer 10c comprises a single paper ply 12c having an offset fold line 14c and a pair of fold lines 16c and 18c defining the panels 20c, 22c, 24c and 26c. Lines of perforations 28c extend longitudinally to define tear strips 30c and transversely extending lines of perforation 36c and 38c equidistantly straddle fold line 14c panels 22c and 24c, respectively. A line of transversely perforations 34c extends adjacent the free end edge of first panel 20c. Lines of adhesive 72 extend along the tear strips 30c in first panel 20c outwardly of lines of perforations 28c. Transverse line of adhesive 46c extends between lines of perforations 28c outwardly of line of perforations 34c in first panel 20c. Lines of adhesives 44c extend longitudinally in panel 24c outwardly of lines of perforations 28c. Along the back side of fourth panel 26c, lines of adhesive 74 extend longitudinally in tear strips 30c.

To form the mailer, the sheet 12c is folded about fold line 14c registering the first and fourth panels and the second and third panels. Lines of adhesive 44c thus register with the tear strips of the second panel 22c and lines of adhesive 72 in first panel 20c register with the tear strips 30c in fourth panel 26c. Upon folding the form about substantially coincident fold lines 16c and 18c, the lines of adhesive 74 on the back face of fourth panel 26c register with the tear strips 30c on the back face of third panel 24c. Additionally, the transverse line of adhesive 46c registers with the third panel 24c between the line of perforations 38c and fold line 14c. Thus, the mailer is completely sealed about its marginal end edges when the heat-sealable adhesive is activated. It will be appreciated with in this form, there is no return envelope and that the transversely extending tear strip for opening the mailer lies along the top portion of the mailer.

Figure 17:
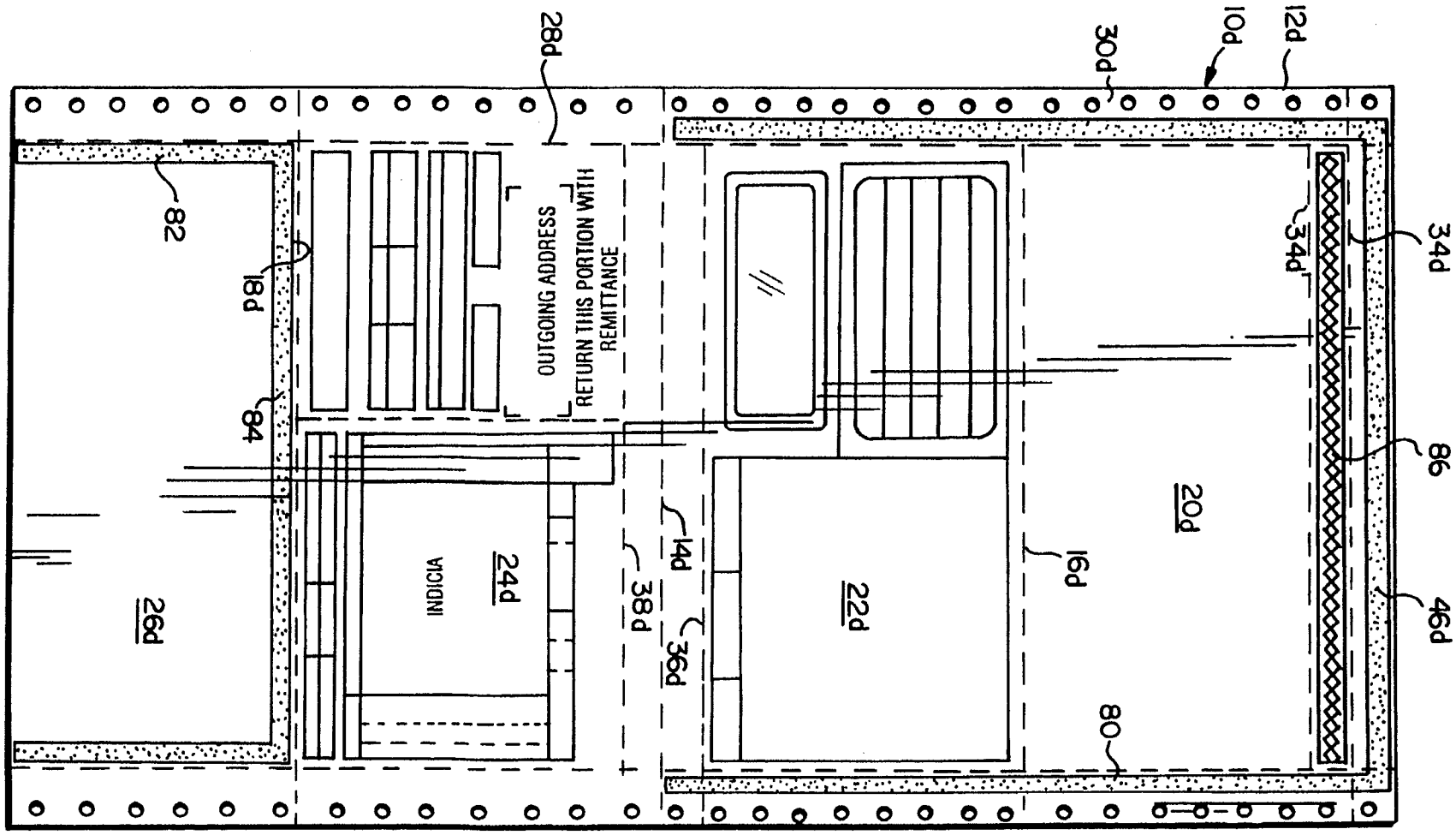
FIGS. 17 and 18 are views similar to FIGS. 1 and 2, respectively, illustrating a fifth embodiment of a business form assembly according to the present invention.
Figure 18:
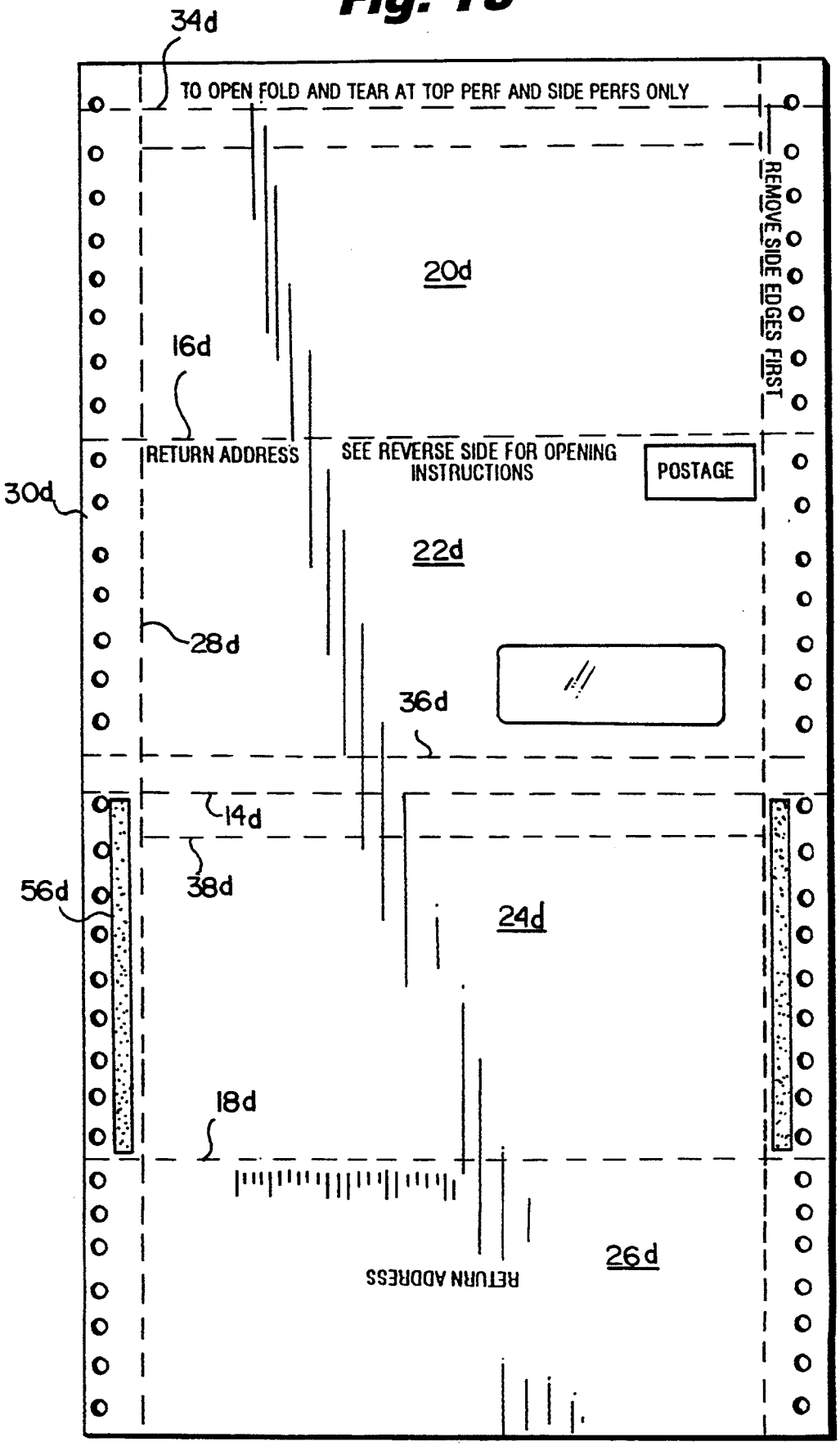

Referring now to the fifth embodiment hereof illustrated in FIGS. 17 and 18, wherein like reference numerals as in the first embodiment are applied, followed by the suffix "d", there is illustrated a business form assembly 10d, comprised of a single ply 12d having an offset fold line 14d and a pair of fold lines 16d and 18d defining first, second, third and fourth panels 20d, 22d, 24d and 26d. In this assembly, longitudinally extending lines of perforations 28d define tear strips 30d along opposite sides of the form. Transverse line of perforations 34d extends adjacent the free end edge of the first panel 20d and transverse lines of perforations 36d and 38d extend in second and third panels 22d 24d equidistantly on opposite sides of fold line 14d. Heat-sealable adhesive 80 extends along the tear strips 30d of the first and second panels and a transverse line of heat-sealable adhesive 46d extends outwardly of line of perforations 34d adjacent the free edge of first panel 20d. Lines of heat-sealable adhesive 56d lie along the marginal tear strips 30d of the third panel 24d on the back face thereof, as illustrated in FIG. 18. Heat-sealable lines of adhesive 82 extend longitudinally along fourth panel 26d inwardly of lines of perforations 28d and a transverse of adhesive 84 extends adjacent fold line 18d whereby lines of adhesive 82 and 84 serve to form a return envelope comprised of the first and fourth panels. A rewettable adhesive 86 extends transversely between lines of perforations 28d inwardly of the line of perforations 34d in first panel 20d. An additional line of perforations 34d' extends transversely and lies inwardly of the line of adhesive 86.

In this form assembly, the fourth panel 26d is substantially shorter than the remaining panels, for example, when folded as previously described about the offset fold line 14d, will lie one inch short of the free edge of the first panel 20d. Consequently, when the assembly 10d is folded about fold line 14d, panels 20d and 26d register one with the other with the free end edge of panel 26d lying substantially coincident with perforation line 34d'. Also, lines of adhesive 80 in the tear strips 30d of the first and second panels 20d and 22d, respectively, will register with the tear strips 30d in the third and fourth panels, respectively. Further folding of the assembly about fold lines 16d and 18d registers line of adhesive 46d with the back face of third panel 24d between fold line 14dand line of perforations 38d. When the heat-sealable adhesive is activated, the registering lines of adhesive 82 and 84 inwardly of the lines of perforations 28d an 16d of first panel 20d form the return envelope. The lines of adhesive 80 along the second panel 22d outwardly of lines of perforations 28d seal with the tear strips 30d along the third panel 24d. The lines of adhesive 80 along the first panel 80 also adhere to the tear strips 30d in fourth panel 26d. The lines of adhesive 56d adhere the marginal strips 30d of the second and third panels 22d and 24d, respectively, along the inside of the mailer. Finally, the transverse line of adhesive 46d seals to the third panel 24d between the line of perforations 38d and fold line 14d.

Upon receipt of the mailer, the recipient tears off the marginal tear strips 30d and the end tear strip along the registering perforation lines 34d, 36d and 38d along the bottom of the mailer. This leaves the return envelope with the second and third panels 22d and 24d being attached to the bottom of the return envelope along the fold lines 16d and 18d. Both panels may then be detached along those fold lines, which may comprise lines of perforations.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A business form assembly comprising:

an elongated single ply of paper folded about first, second and third transversely extending parallel fold lines to form first, second, third and fourth transversely extending panels with the first and second panels forming outside panels and said third and fourth panels within said first and second panels, said first fold line being offset from a median across the ply such that said fourth panel is shorter in longitudinal extent than the longitudinal extent of each of said first, second and third panels and terminates along an edge of said ply spaced from the first fold line;

marginal lines of perforations extending longitudinally, parallel to one another, adjacent opposite edges of said ply and normal to said fold lines defining tear strips along longitudinally extending opposite margins of said ply;

a first line of perforations spaced inwardly of an edge of said first panel and said ply and extending transversely between said marginal lines of perforation in said first panel, second and third lines of perforations extending transversely between said marginal lines of perforations in said second and third panels generally parallel to and spaced equidistantly on opposite sides of said first fold line, respectively;

a first line of adhesive extending transversely generally parallel to said edge of said first panel and between said tear strips for sealing said first panel and said third panel adjacent said first fold line, said first line of adhesive lying between said edge and said first line of perforations in said first panel;

marginal lines of adhesive along at least portions of said tear strips and laterally outwardly of said marginal lines of perforations to maintain said form in assembly, the first, second and third transversely extending lines of perforations lying in registry one with the other forming a transversely extending tear strip adjacent one laterally extending edge of the form assembly, while the marginal lines of perforation adjacent opposite edges of the ply register one with the other, forming a pair of tear strips along opposite margins of the form assembly.

2. A business form assembly according to claim 1 including lines of adhesive extending longitudinally inside the marginal lines of perforations along one of said panels and a line of adhesive extending transversely along said one panel, or a panel in registration with said one panel in said assembly, adjacent a fold line to form a return envelope with the registering panel in said assembly.

3. A business form assembly according to claim 2 wherein said return envelope comprises said second and third panels.

4. A business form assembly according to claim 2 wherein said return envelope comprises said first and fourth panels.

5. A business form assembly according to claim 2 including a rewettable adhesive extending transversely adjacent an edge portion of a panel other than the panels forming said return envelope whereby the edge portion of said other panel forms a closure flap for the return envelope.

6. A business form assembly according to claim 5 wherein said return envelope comprises said second and third panels, said other panel comprising said fourth panel.

7. A business form assembly according to claim 6 wherein said rewettable adhesive lies along said edge of said fourth panel.

8. A business form assembly according to claim 6 wherein said rewettable adhesive lies along said fourth panel adjacent said third fold line.

9. A business form assembly according to claim 8 including a line of perforations extending transversely and located between said rewettable adhesive and said edge of said fourth panel.

10. A business form assembly according to claim 2 wherein said return envelope is comprised of said first and fourth panels, a rewettable adhesive extending transversely adjacent an edge portion of said first panel inwardly of said first line of adhesive.

11. A business form assembly comprising:

an elongated single ply of paper folded about first, second and third transversely extending parallel fold lines to form first, second, third and fourth transversely extending panels with said panels in registration with one another, a pair of said panels forming outside panels and another pair of said panels forming inside panels, said first fold line being offset from a median across the ply such that one of said panels is shorter in longitudinal extent than the longitudinal extent of each other of said panels;

marginal lines of perforations extending longitudinally, parallel to one another, adjacent opposite edges of said ply and normal to said fold lines defining tear strips along longitudinally extending opposite margins of said ply;

a first line of perforations spaced inwardly of an edge of one of said outside panels and said ply and extending transversely between said marginal lines of perforations in said one outside panel, second and third lines of perforations extending transversely between said marginal lines of perforations in said inside panels generally parallel to and spaced equidistantly on opposite sides of said first fold line, respectively;

a first line of adhesive extending transversely generally parallel to said edge of said one outside panel and between said tear strips for sealing said one outside panel and one of said inside panels adjacent said first fold line, said first line of adhesive lying between said edge of said one outside panel and said first line of perforations in said one outside panel;

marginal lines of adhesive along at least portions of said feed strips and laterally outwardly of said marginal lines of perforations to maintain said form in assembly, the first, second and third transversely extending lines of perforations lying in registry one with the other forming a transversely extending tear strip adjacent one laterally extending edge of the form assembly, while the marginal lines of perforation adjacent opposite edges of the ply register one with the other, forming a pair of tear strips along opposite margins of the form assembly.

12. A business form assembly according to claim 11 including lines of adhesive extending longitudinally inside the marginal lines of perforations along one of said panels and a line of adhesive extending transversely along said one panel, or a panel in registration with said one panel in said assembly, adjacent a fold line to form a return envelope with the registering panel in said assembly.

13. A business form assembly according to claim 12 wherein said return envelope comprises one panel of said one pair of outside panels and one panel of said pair of inside panels.

14. A business form assembly according to claim 12 including a rewettable adhesive extending transversely adjacent an edge portion of a panel other than the panels forming said return envelope whereby the edge portion of said other panel forms a closure flap for the return envelope.

15. A business form comprising:

an elongated single ply of paper having first, second and third transversely extending parallel fold lines and defining first, second, third and fourth transversely extending panels, said first fold line being offset from a median across the ply such that said fourth panel is shorter in longitudinal extent than the longitudinal extent of each of said first, second and third panels and terminates along an edge of said ply spaced from said first fold line;

marginal lines of perforations extending longitudinally, parallel to one another, adjacent opposite edges of said ply and normal to said fold lines defining tear strips along longitudinally extending opposite margins of said ply;

a first line of perforations spaced inwardly of an edge of said first panel and said ply and extending transversely between said marginal lines of perforation in said first panel, second and third lines of perforations extending transversely between said marginal lines of perforations in said second and third panels generally parallel to and spaced equidistantly on opposite sides of said first fold line, respectively;

a first line of adhesive extending transversely generally parallel to said edge of said first panel and between said tear strips for sealing said first panel and said third panel adjacent said first fold line when said form is folded about said first, second and third fold lines with the first and second panels forming outside panels and said third and fourth panels located within said first and second panels, said first line of adhesive lying between said edge and said first line of perforations in said first panel;

marginal lines of adhesive along at least portions of said tear strips and laterally outwardly of said marginal lines of perforations to maintain said form in assembly when folded, such that, when folded, the first, second and third transversely extending lines of perforations lie in registry one with the other to form a transversely extending tear strip adjacent one laterally extending edge of the form in assembly and the marginal lines of perforation adjacent opposite edges of the ply register with one another to form a pair of tear strips along opposite margins of the form.

16. A business form according to claim 15 including lines of adhesive extending longitudinally inside the marginal lines of perforations along one of said panels and a line of adhesive extending transversely along said one panel.

* * * * *